US005137559A

United States Patent [19]

Agrawal

[11] Patent Number: 5,137,559

[45] Date of Patent: Aug. 11, 1992

[54] PRODUCTION OF NITROGEN FREE OF LIGHT IMPURITIES

[75] Inventor: Rakesh Agrawal, Allentown, Pa.

[73] Assignee: Air Products and Chemicals, Inc., Allentown, Pa.

[21] Appl. No.: 633,826

[22] Filed: Dec. 26, 1990

Related U.S. Application Data

[63] Continuation-in-part of Ser. No. 562,878, Aug. 6, 1990, abandoned.

[51] Int. Cl.[5] ..... F25J 3/02

[52] U.S. Cl. ..... 62/24; 62/44

[58] Field of Search ..... 62/13, 22, 24, 44

[56] References Cited

U.S. PATENT DOCUMENTS

| | | | |
|---|---|---|---|
| 3,905,201 | 9/1975 | Coveney et al. | 62/13 |
| 3,947,259 | 3/1976 | Frischbier | 62/13 |
| 4,579,566 | 4/1986 | Brugerolle | 62/22 |
| 4,715,873 | 12/1987 | Auvil et al. | 62/22 |
| 4,817,394 | 4/1989 | Erickson | 62/22 |
| 4,824,453 | 4/1989 | Rottman et al. | 62/22 |
| 4,843,828 | 7/1989 | Gladman | 62/24 |
| 4,902,321 | 2/1990 | Cheung | 62/24 |
| 4,936,099 | 6/1990 | Woodward et al. | 62/24 |

FOREIGN PATENT DOCUMENTS 376465 7/1990 European Pat. Off. .

*Primary Examiner*—Ronald C. Capossela
*Attorney, Agent, or Firm*—Russell L. Brewer; James C. Simmons; William F. Marsh

[57] ABSTRACT

This invention relates to a cryogenic process for the separation of air utilizing an integrated multi-column distillation system wherein an ultra high purity nitrogen rich, oxygen rich and optionally an argon rich product are generated. In the cryogenic distillation separation of air, air is initially compressed, pretreated and cooled for separation into its components. Ultra high purity, e.g., nitrogen having less than 0.1 ppm of volatile impurities is generated with enhanced nitrogen product recovery by withdrawing liquid nitrogen from the higher pressure column at an intermediate point and charging that fraction as reflux to the lower pressure column, withdrawing a nitrogen stream which is rich in volatile contaminants from the top of the high pressure column, partially condensing the nitrogen stream and removing the uncondensed portion as a purge stream, and, withdrawing an ultra high purity nitrogen product at a point below a nitrogen vapor withdrawal point at the top of the lower pressure column. Alternatively, no purge need be taken and the volatile impurities allowed to pass to the low pressure column. In that case, a nitrogen fraction rich in volatile impurities is removed from an upper portion of the low pressure column, condensed and at least a portion of the uncondensed fraction removed as a purge and the condensed portion returned to the low pressure column.

18 Claims, 5 Drawing Sheets

PRODUCTION OF NITROGEN FREE OF LIGHT IMPURITIES

CROSS-REFERENCE TO RELATED APPLICATION

This application is a continuation-in-part of copending application having Ser. No. 07/562,878 and a filing date of Aug. 6, 1990 now abandoned. The subject matter of that application is incorporated by reference.

TECHNICAL FIELD OF THE INVENTION

This invention relates to cryogenic process for the separation of air and recovering ultra high purity nitrogen with high nitrogen recovery.

BACKGROUND OF THE INVENTION

Numerous processes are known for the separation of air by cryogenic distillation into its constituent components. Typically, the air separation process involves removal of contaminant materials such as carbon dioxide and water from a compressed air stream prior to cooling to near its dew point. The cooled air then is cryogenically distilled in an integrated multi-column distillation system having a high pressure column, a low pressure column and a side arm column for the separation of argon. The side arm column for the separation of argon typically communicates with the low pressure column in that an argon/oxygen stream containing about 8–12% argon is removed and cryogenically distilled in the side arm column.

Processes to produce a high purity nitrogen stream containing few light contaminants, such as hydrogen, helium and neon have been proposed. Concentration of some of these contaminants in the feed air can be as high as 20 ppm. Almost all of these light components show up in final nitrogen product from an air separation unit (ASU). In some cases, such as for the electronic industry, this contamination level is unacceptable in the end use of this nitrogen product.

The following patents disclose approaches to the problem.

U.S. Pat. No. 4,824,453 discloses a process for producing ultra high purity oxygen as well as high purity nitrogen, where the nitrogen purity exceeds 99.998% and the amount of impurities is generally less than 10 ppm. More specifically, air is compressed, cooled and distilled in a rectification system wherein in a first stage rectification an oxygen enriched fraction is removed from the bottom and a nitrogen rich liquid fraction is removed from an upper portion of the first stage rectification, sub-cooled and returned as reflux to the top of the second stage rectification. A nitrogen rich liquid is removed from an upper portion of the second stage at a point just below an overhead removal point for nitrogen vapor from the second stage rectification. Liquid oxygen from the bottom of the first stage is sub-cooled, expanded and used to drive a boiler/condenser in the top of the high purity argon column. Nitrogen vapor from the top of the first stage is used to drive a reboiler/condenser in the bottom of a high purity oxygen column. To enhance product purity, a portion of the gaseous nitrogen stream from the top of the high pressure column is removed as purge.

U.S. Pat. No. 4,902,321 discloses a process for producing ultra high purity nitrogen in a multi-column system. Air is compressed, cooled and charged to a high pressure column where it is separated into its own components generating an oxygen liquid at the bottom and a nitrogen rich vapor at the top. The oxygen liquid is expanded and used to drive a boiler/condenser which is thermally linked to the top of the high pressure column for condensing the nitrogen rich vapor. A portion of the nitrogen rich vapor is removed from the top of the high pressure column and condensed in the tube side of a heat exchanger. The resulting liquid nitrogen is expanded and charged to a top of a stripping column wherein nitrogen including impurities are flashed from the stripping column. Any impurities not removed by flashing are stripped by passing a stream of substantially pure nitrogen upwardly through the column. The nitrogen liquid collected at the bottom of the stripping column is pumped to the shell side of the heat exchanger, vaporized against the nitrogen-rich vapor and removed as high purity product.

European Patent 0 0376 465 discloses an air separation process for producing ultra high purity nitrogen product. In the process, nitrogen product from a conventional air separation process is charged to the bottom of a column equipped with a reflux condenser. Liquid nitrogen is withdrawn from an upper portion of the column and flashed generating a liquid and a vapor. The liquid obtained after flashing is then flashed a second time and the resulting liquid recovered.

There are essentially two problems associated with the processes described for producing ultra-high purity nitrogen and these problems relate to the fact that in the '453 disclosure purities are quite often not sufficiently high to meet industry specifications and in the '321 process nitrogen recoveries are too low. The same can be said of the '465 European Patent.

SUMMARY OF THE INVENTION

This invention relates to an air separation process for producing ultra high purity nitrogen as product with high nitrogen recovery. In the basic cryogenic process for the separation of air which comprises nitrogen, oxygen and volatile and condensible impurities in an integrated multi-column distillation system having a higher pressure column and a lower pressure column an air stream is compressed, freed of condensible impurities, and cooled generating a feed for the integrated multi-column distillation system. The improvement in this basic process for producing ultra high purity nitrogen at high nitrogen recovery comprises:

a) generating a liquid nitrogen fraction and a nitrogen rich vapor fraction containing volatile impurities near the top of the higher pressure column;

b) removing a portion of the liquid nitrogen fraction from the higher pressure column;

c) expanding the liquid nitrogen fraction and introducing the expanded fraction to the top of the lower pressure column as feed;

d) generating a nitrogen rich vapor fraction containing residual volatile impurities at the top of the lower pressure column and removing that fraction as an overhead;

e) partially condensing at least one of said nitrogen rich vapor fractions generated in step (a) or (d) or both in a boiler/condenser;

f) removing at least a portion of at least one of the uncondensed nitrogen rich vapor fractions concentrated in volatile impurities from the boiler/condenser as a purge stream;

g) returning at least a portion of at least one of the condensed nitrogen rich vapor fractions to a column as reflux; and, h) generating and removing an ultra high purity nitrogen fraction as product from the lower pressure column at a point below the removal point for the nitrogen rich vapor containing volatile impurities and below the point of return of the liquid nitrogen fraction as reflux to the lower pressure column.

In another embodiment, which includes argon recovery, an air stream is compressed, freed of condensible impurities, and cooled forming a cooled air stream. The air stream then is cryogenically distilled in an integrated multi-column distillation system having a higher pressure column, a lower pressure column, and a side arm column for effecting separation of argon from oxygen. The improvement for producing ultra high purity nitrogen product comprises:

a) feeding substantially all of said cooled air stream to the higher pressure column;

b) generating a liquid nitrogen fraction and a nitrogen rich vapor fraction containing volatile impurities near the top of the higher pressure column;

c) removing a portion of the liquid nitrogen fraction from the higher pressure column at a point below a removal point designated for the removal of a nitrogen rich vapor fraction containing volatile impurities;

d) expanding the liquid nitrogen fraction and introducting the expanded fraction to the top of the lower pressure column as feed;

e) generating a nitrogen rich vapor fraction containing residual volatile impurities fraction at the top of the lower pressure column and removing that fraction as an overhead; and, f) partially condensing at least one of said nitrogen rich vapor fractions generated in step (b) or step (e) in a boiler/condenser and returning at least a portion of at least one the condensed nitrogen rich vapor fractions to a column as reflux;

g) removing at least a portion of at least one of the uncondensed nitrogen rich vapor fractions concentrated in volatile impurities generated in step (f) from the boiler/condenser as a purge stream;

h) removing an argon stream from the low pressure column and fractionating that argon stream in said side arm column and recovering an argon rich product as overhead; and, j) generating and removing an ultra high purity nitrogen fraction as product from the lower pressure column at a point below the removal point for the nitrogen rich vapor containing residual volatile impurities and below the point of return of the liquid nitrogen fraction as reflux to the lower pressure column.

The advantages for obtaining ultra high purity nitrogen at high recovery are achieved by concentrating volatile impurities in purge streams and minimizing the volume of these purge streams at strategic locations in the process.

DRAWINGS

DETAILED DESCRIPTION OF THE INVENTION

Figure 1:
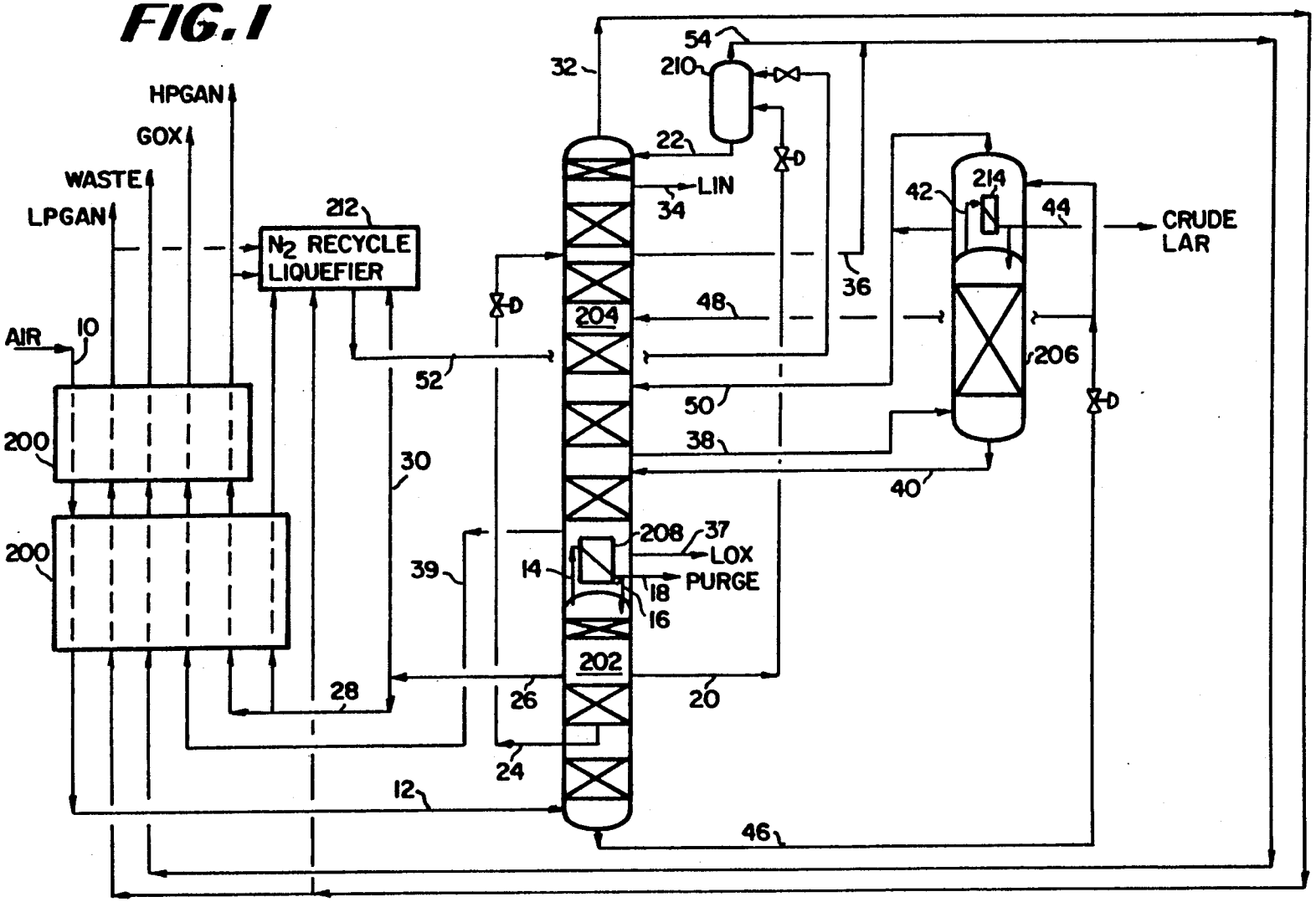
FIG. 1 is a schematic representation of an embodiment for generating ultra high purity nitrogen with enhanced nitrogen recovery.

To facilitate an understanding of the invention and the concepts for generating an ultra high purity nitrogen product having a volatile impurity content of less than 5 ppm and preferably less than 0.1 ppm, reference is made to FIG. 1. More particularly, a feed air stream 10 is initially prepared from an air stream by compressing an air stream comprising oxygen, nitrogen, argon, volatile impurities such as hydrogen, neon, helium, and the like, and condensible impurities, such as, carbon dioxide and water in a multi-stage compressor system to a pressure ranging from about 80 to 300 psia and typically in the range of 90–180 psia. Volatile impurities have a much lower boiling point than nitrogen. This compressed air stream is cooled with cooling water and chilled against a refrigerant and then passed through a molecular sieve bed to free it of condensable water and carbon dioxide impurities.

The integrated multi-column distillation system comprises a high pressure column 202, a low pressure column 204 and, optionally, a side arm column 206 for effecting argon separation. High pressure column 202 is operated at a pressure close to the pressure of feed air stream 10, e.g., 80 to 300 psia and air is separated into its components by intimate contact of the vapor and liquid in the column. High pressure column 202 is equipped with distillation trays or packing, either medium being suited for effecting liquid/vapor contact. A high pressure nitrogen vapor stream containing volatile impurities is generated at the top portion of high pressure column 202 and a crude liquid oxygen stream is generated at the bottom of high pressure column 202.

Low pressure column 204 typically is operated within a pressure range from about 15–80 psia and preferably in the range of about 18 to 25 psia in order to produce an ultra high purity nitrogen product. The objective in the lower pressure column is to provide high purity nitrogen, e.g., greater than 99.998% preferably 99.999% by volume purity at the top of the column, with minimal argon loss and to generate a high purity oxygen stream. Low pressure column 204 is equipped with vapor liquid contact medium which comprises distillation trays or packing.

An argon side arm column 206 is in communication with the low pressure column 204 and generates an argon stream as an overhead and an oxygen stream as a bottoms. The column typically operates at a pressure close to the low pressure column pressure, e.g., 15 to 80 psia and preferably in the range of about 18 to 25 psia.

In the process of FIG. 1, stream 10, which is free of condensible impurities, is cooled to near its dew point in main heat exchanger system 200, which forms the feed via stream 12 to high pressure column 202 associated with the integrated multi-column distillation system. A high pressure nitrogen rich vapor containing volatile impurities is generated as an overhead and a liquid oxygen fraction as a bottoms fraction. In one embodiment at least a portion of the high pressure nitrogen vapor generated in high pressure column 202 is withdrawn via line 14 and substantially all of it is condensed in boiler/condenser 208 in the lower portion of low pressure column 204. Condensation of the nitrogen rich vapor containing impurities provides boil-up and condensation reduces the level of volatile impurities in the condensed liquid phase and concentrates the impurities in the vapor phase. The condensed nitrogen is withdrawn from boiler/condenser 208 and a portion is directed to high pressure column 202 as reflux via line 16. The condensed fraction may be introduced as reflux as desired to other columns. The uncondensed balance of the high pressure nitrogen is removed via line 18 as a purge. However, it is possible to return the fraction to first column 202 and remove volatile contaminants at another point. In another embodiment, no purge would be taken and substantially all of the nitrogen vapor fraction would be condensed in boiler/condenser 208. The condensed fraction then would be returned to the first or high pressure column 202.

A liquid nitrogen fraction is collected at a point typically about 3-5 trays below the nitrogen removal point via line 14 in high pressure column 202. That liquid nitrogen fraction is removed via line 20, typically, isenthalpically expanded and the volatile impurities flashed therefrom in separator 210. The liquid phase from separator 210 is introduced via line 22 to the top of low pressure column 204 as reflux. An optional impure liquid fraction is removed from the middle to lower section of high pressure column 202 via line 24, expanded and charged to a middle section of low pressure column 204 as reflux. Another vapor fraction is removed via line 26 and split into two fractions. One fraction is removed via line 28 and warmed in main heat exchanger system 200 and recovered as high pressure gaseous nitrogen (HPGAN) and the other is passed via line 30 to nitrogen recycle liquefier 212 for liquefaction.

It is in low pressure column 204 where ultra high purity nitrogen and high purity oxygen is produced. A nitrogen rich stream containing residual volatile impurities is generated, if not removed in high pressure column 202, and removed from the top or upper-most portion of low pressure column 204 via line 32 wherein it is warmed against other process fluids in heat exchanger system 200 and recovered as low pressure gaseous nitrogen (LPGAN). The warmed nitrogen vapor stream is removed from heat exchanger system 200. The concentration of residual volatile impurities in nitrogen vapor stream 32 is primarily controlled by any nitrogen purge stream removed from an upper portion of high pressure column 204 via line 18. Recovery of nitrogen in the process is controlled by the volume of the purge stream 18. An ultra high purity nitrogen product is generated as a liquid fraction (LIN) near the upper portion of the low pressure column 204 and removed via line 34. Typically, this removal point is a few trays, e.g., 2-5 trays below the removal point of the nitrogen vapor via line 32. It is also below the introduction point for the high purity nitrogen reflux from separator 210 and above the waste nitrogen vapor removal via line 36 near the middle to upper portion of low pressure column 204. A high purity oxygen stream is removed as liquid from low pressure column 204 via line 37 and a high purity oxygen stream is removed as vapor via line 39 warmed in main heat exchanger system 200 and recovered as gaseous oxygen (GOX).

An argon containing vapor stream having a concentration of from about 8 to 12% argon is removed from an intermediate point in low pressure column 204 via line 38 and charged to side arm column 206 for separation. Argon is separated from oxygen in side arm column 206 and a bottoms fraction rich in oxygen is withdrawn from the bottom of column 206 and returned via line 40 to low pressure column 204. Side arm column 206, like high pressure column 202 and low pressure column 204, is equipped with vapor-liquid contact medium such as trays or packing. An argon rich vapor stream is removed from the side arm column 206 via line 42, wherein it is condensed in boiler/condenser 214 at the top of the column 206. A portion of the condensed argon stream is returned to argon column 204 as reflux and the balance of the stream is removed via line 44 and recovered as a crude liquid argon stream (crude LAR). The boiler/condenser in argon side arm column 206 is cooled by removing liquid oxygen from the bottom of high pressure column 202 via line 46, expanding that liquid, and partially vaporizing a fraction of that liquid in boiler/condenser 214. A portion of the unvaporized fraction is charged as reflux via line 48 to low pressure column 204 and the vaporized portion is removed from boiler/condenser 214 and charged via line 50 as feed to the low pressure column.

High purity nitrogen reflux for the low pressure column is obtained by expanding a liquid nitrogen fraction obtained from the high pressure column, as stated, and obtaining supplemental nitrogen from nitrogen recycle liquefier 212, as required. The nitrogen from nitrogen recycle liquefier 212 is conveyed via line 52, expanded and flashed in separator 210. The overhead from separator 210 contains some volatile contaminants and is removed from the system via line 54 as waste. Optionally, it is combined with the waste stream 36 from the low pressure column.

Figure 2:
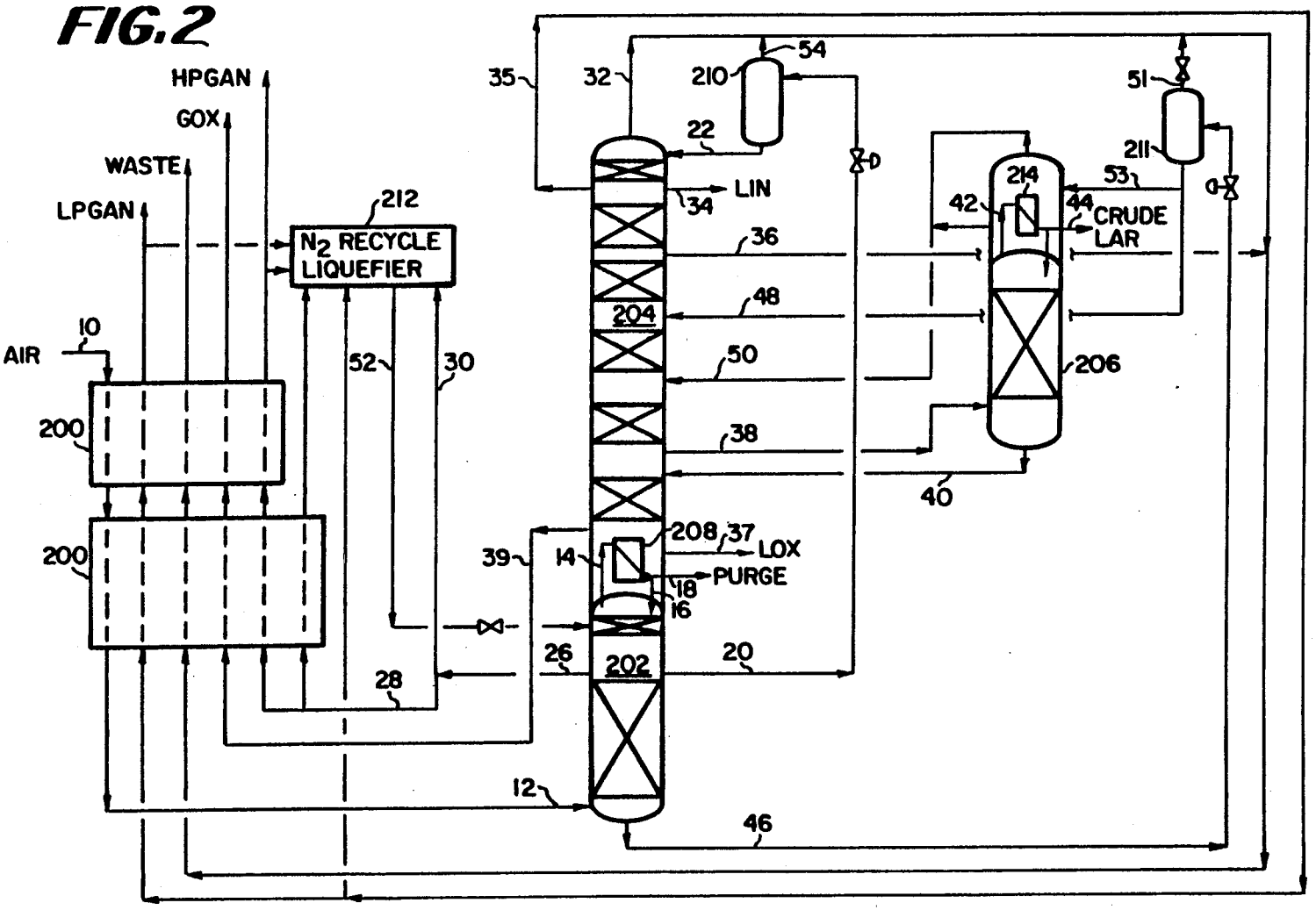
FIG. 2 is a schematic representation of a variation of the process in FIG. 1 wherein a portion of the nitrogen from the nitrogen liquifier expanded to provide refrigeration and charged to the higher pressure column and a nitrogen vapor stream is removed in addition to the liquid nitrogen stream near the top of the lower pressure column.

FIG. 2 represents a schematic representation of another embodiment of a variation of the process of FIG. 1 for generating ultra high purity gaseous nitrogen product in the low pressure column. A numbering system similar to that of FIG. 1 has been used for common equipment and streams and comments regarding column separations will be limited to the significant differences between this process and that described in FIG. 1.

One difference between the process of FIG. 1 to that in FIG. 2 is that in FIG. 2, the liquid nitrogen from nitrogen liquefier 212, which has a significant concentration of lights, is fed via line 52 to the high pressure column rather than to separator 210. Preferably, the feed location of this liquid is chosen to match the concentration of the lights on the tray at its feed point. Typically it will be fed at least one tray above the withdrawal tray for liquid nitrogen stream 20. This allows a higher rejection of the lights through purge stream 18 from boiler/condenser 208 and the liquid nitrogen feed to separator 212 has a much lower concentration of the lights. This reduces the concentration of light contaminants in liquid stream 22 exiting separator 210 and fed to low pressure column 204. Another distinction between the flow sheets of FIG. 2 and that of FIG. 1 is that a vapor stream rich in residual lights or impurities is removed via line 32 as a purge allowing a higher purity, low pressure ultra high purity gaseous nitrogen fraction to be produced. It contains contaminants and aids in controlling the contaminant level in liquid stream 34. Almost all of the low pressure ultra high purity nitrogen product is recovered through line 35. Although not shown, vapor stream 54 from the separator 210 may not need to be vented. It can be mixed with the gaseous nitrogen stream 32 from the top of the low pressure column 204 and sent to nitrogen recycle liquefier 212.

In the processes of FIG. 1 and FIG. 2, a large fraction of the contaminants in the gaseous nitrogen from the top section of the low pressure column (streams 32 in FIG. 1 and 35 in FIG. 2) comes from crude liquid oxygen stream 46. This crude liquid oxygen stream in the bottom of the high pressure column is in contact with the incoming feed air and accordingly picks up a significant concentration of light contaminants. In order to reduce the level of impurities in the crude liquid oxygen prior to introduction as reflux to low pressure column 204, an alternative is to expand the crude liquid oxygen stream from the bottom of the high pressure column prior to feeding it to the low pressure column or the boiler/condenser located at the top of the crude argon column. The expanded fraction then is fed to separator 211 and the flashed vapor from the top of this separator is taken as a purge stream 51. A fraction of this liquid is returned to the vaporizer side of boiler/condenser 214 and the other is fed to the low pressure column.

Figure 3:
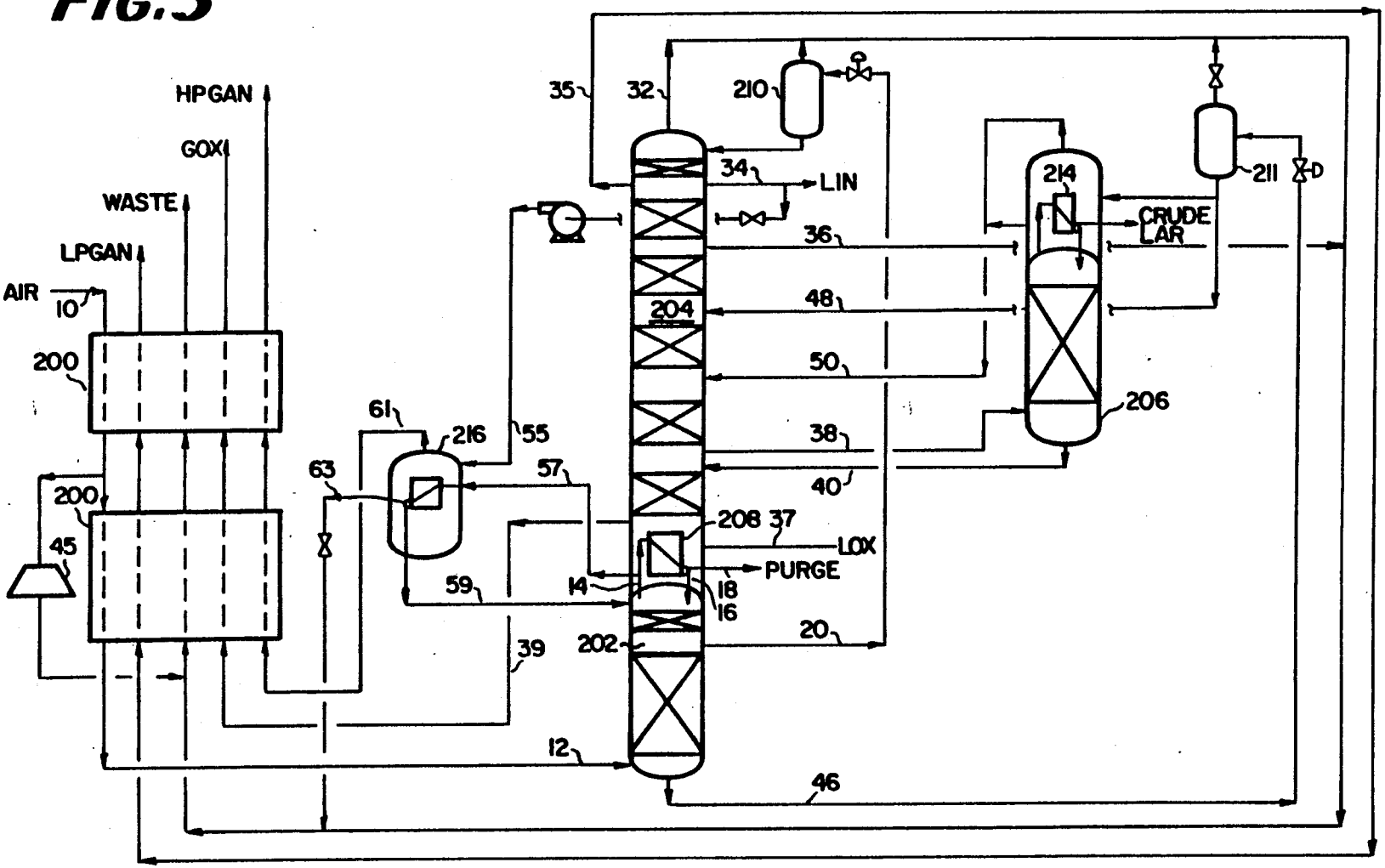
FIG. 3 is a schematic representation of a variation of the process of FIG. 2 wherein a separate boiler/condenser is used to condense a portion of the nitrogen rich vapor containing impurities from the high pressure column against a portion of the liquid nitrogen product from the lower pressure column.

FIG. 3 shows a flowsheet for the production of all gaseous products and a part of the nitrogen product is produced at a high pressure and at extremely high-purity. This is achieved by taking a portion of liquid nitrogen stream 34 from the low pressure column and pumping it to a higher pressure. The higher pressure liquid nitrogen stream 55 is then fed to an auxiliary boiler/condenser 216 where it is boiled against a high pressure nitrogen stream containing volatile impurities which is withdrawn from the top of the high pressure column 202 via line 57. The condensed liquid nitrogen stream 59 is returned to the high pressure column as reflux while boiled stream 61 is warmed in main heat exchanger system 200 to provide high purity gaseous nitrogen stream at high pressure. A portion of the uncondensed stream rich in volatile impurities is removed via line 63 and discharged as waste. A turboexpander 45 is used to provide refrigeration.

Figure 4:
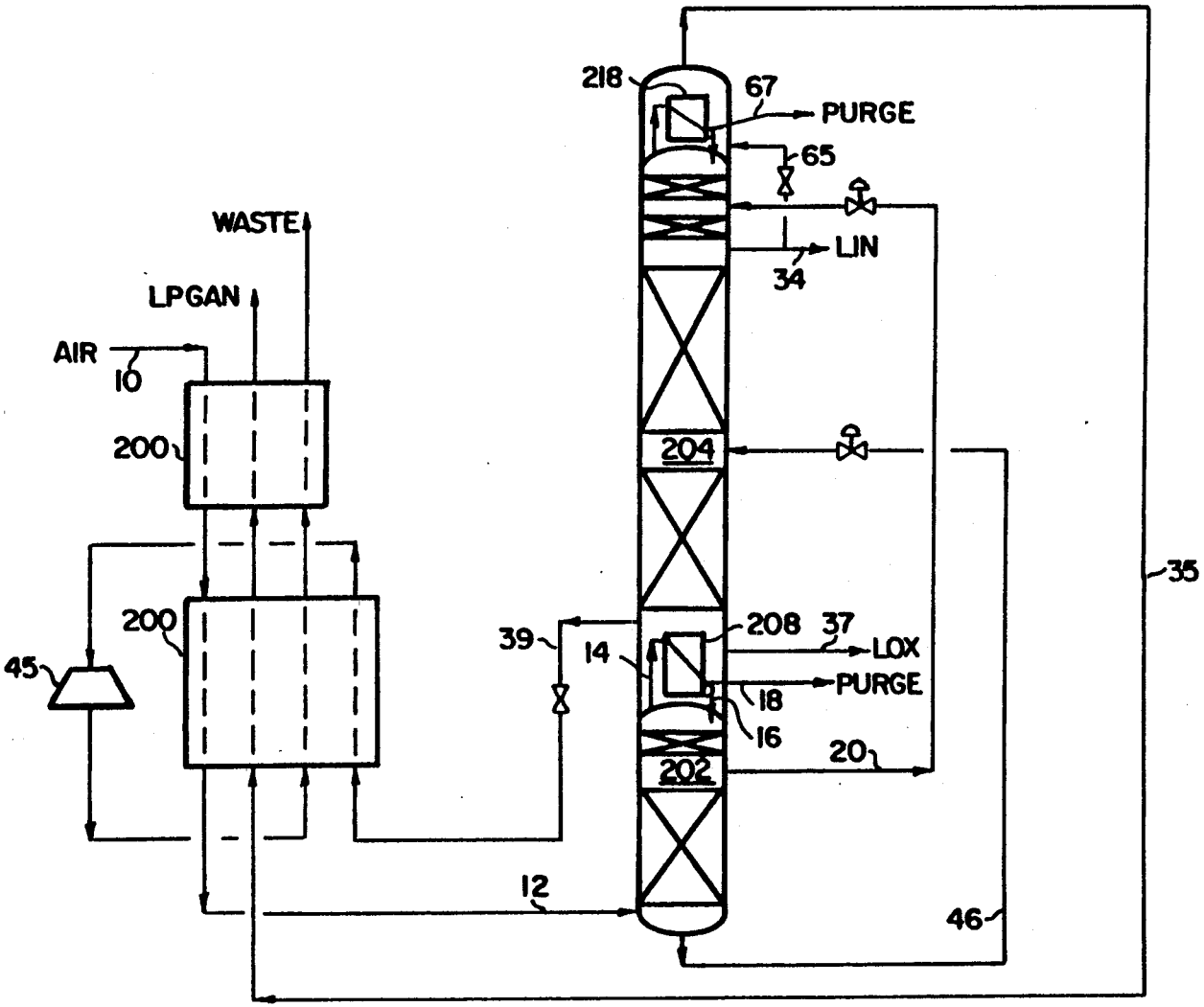
FIG. 4 is a schematic representation of a variation of FIG. 1 in that a portion of the liquid nitrogen from the lower pressure column is expanded and used to condense a nitrogen fraction in the overhead the lower pressure column. A turboexpander is provided for additional refrigeration.

FIG. 4 represents a process scheme for the production of ultra high purity gaseous nitrogen. In this process a portion of the liquid nitrogen from low pressure column 204 removed via line 34 is isenthalpically expanded. That stream is conveyed via line 65 to boiler/condenser 218 at the top of the low pressure column 204 and used to condense the nitrogen rich faction. A purge stream 67 is taken from this section. Purge streams 18 and 67, which contain a high concentration of light contaminants, can both be combined with waste stream 39 prior to expansion in turboexpander 45.

Figure 5:
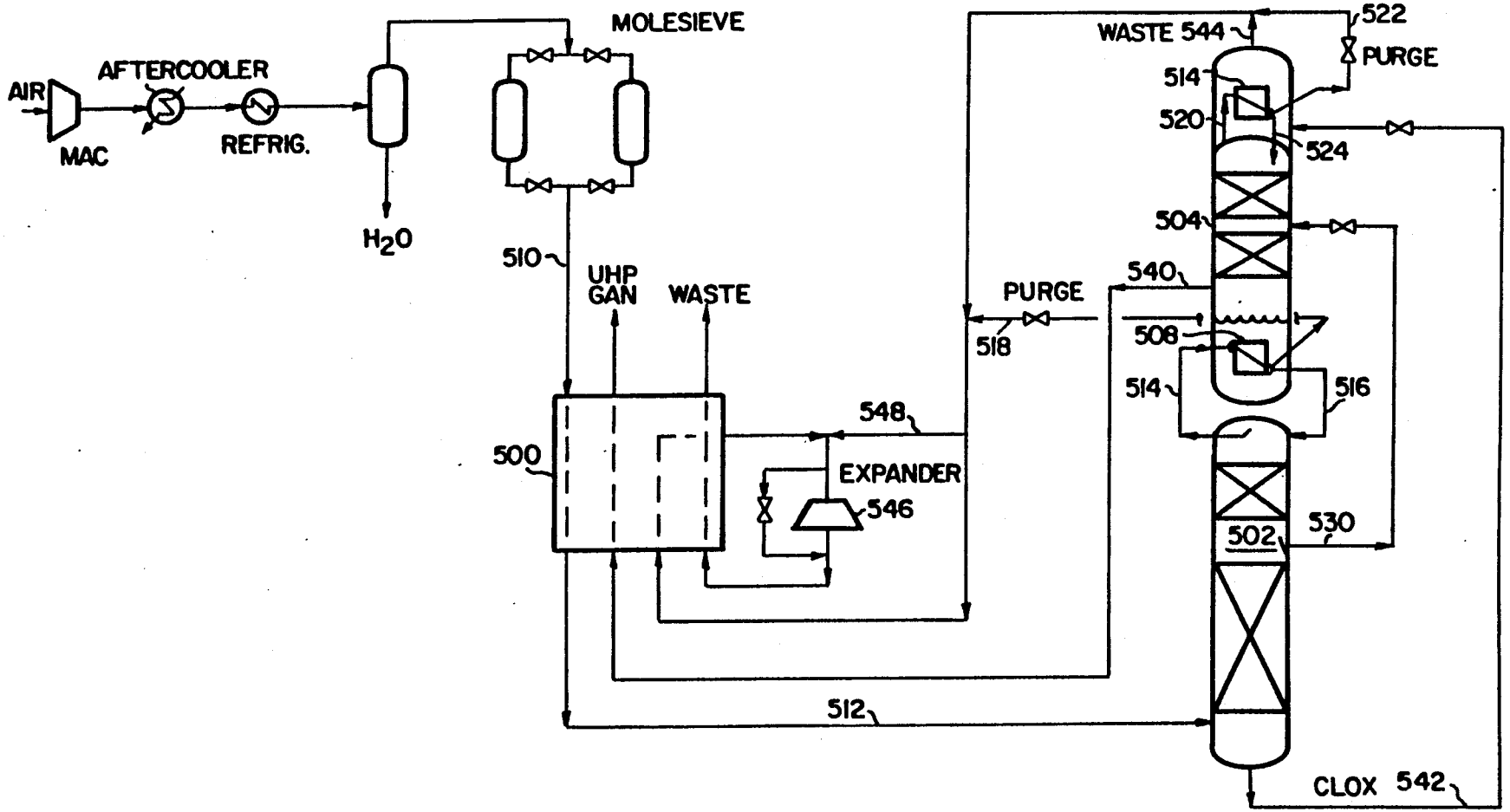
FIG. 5 is a schematic representation of a variation of FIG. 1 in that only a portion of the uncondensed nitrogen fraction from the lower pressure column is removed as a purge.

Referring to FIG. 5, a feed air stream is initially prepared from an air stream by compressing an air stream comprising oxygen, nitrogen, argon, volatile impurities such as hydrogen, neon, helium, and the like, and condensible impurities, such as, carbon dioxide and water in a multi-stage compressor system to a pressure ranging from about 80 to 300 psia. This compressed air stream is cooled with cooling water and chilled against a refrigerant and then passed through a molecular sieve bed to free it of condensable water and carbon dioxide impurities to provide stream 510.

In the process an air stream 510 free of condensible impurities is cooled to near its dew point in main heat exchanger system 500. The air stream then forms the feed via stream 512 to high pressure column 502 associated with the integrated multi-column distillation system. A nitrogen rich vapor containing volatile impurities is generated as an overhead and a crude liquid oxygen fraction as a fraction. At least a portion of the nitrogen vapor generated in high pressure column 502 is withdrawn via line 514 and partially condensed in boiler/condenser 508 in the bottom portion of low pressure column 504. Condensation of the nitrogen rich vapor containing impurities provides boil-up in the low pressure column. The condensed nitrogen which has a fractional amount of impurities is withdrawn from boiler/condenser 508 and at least a portion directed to the top of high pressure column 502 as reflux via line 516. The uncondensed portion which in concentrated in volatile impurities is taken as purge via line 518. A nitrogen-rich liquid is withdrawn from the upper portion of the high pressure column 502 via line 530 and is expanded and fed to an upper portion of low pressure column 504.

It is in low pressure column 504 where the ultra high purity nitrogen product is produced. In the embodiment of FIG. 5, a nitrogen stream rich in volatile impurities is generated in the top or upper most portion of the low pressure column 504. Depending on the amount of impurities removed in first column 502, volatile impurities will be present in the upper most portion of low pressure column 504. The nitrogen rich fraction containing volatile impurities is removed as an overhead via line 520 and partially condensed in boiler/condenser 514. Uncondensed gases which are rich in volatile impurities are removed as a purge stream via line 522 with the condensed fraction being returned to low pressure column 504 via line 524. An ultra high purity nitrogen product, e.g., product containing less than 5 ppm and preferably less than 0.1 ppm residual contaminants is removed via line 540 at a point below the removal point for volatile impurities in column 504.

To obtain the necessary refrigeration for producing ultra high purity nitrogen product in this process crude liquid oxygen is removed from high pressure column 502 as a bottoms fraction via line 542, expanded and then charged to the vaporizer section of boiler/condensed 514 located at the top of the low pressure column 504. The vaporized oxygen is removed via line 544 as an overhead. Some of the overhead is diverted to a turboexpander 546 via line 548 with the balance being warmed in main heat exchanger 500 and then diverted to turboexpander 546. The exhaust from turboexpander 546 is warmed against process fluids in heat exchanger 500 and then discharged as waste. Optionally, a small fraction of the feed to turboexpander 546 may be diverted through an expansion valve and then discharged as waste as shown.

Further embodiments of FIGS. 1-5 are envisioned and generally involve the reduction of volatile impurities in feed streams prior to introduction to the low pressure column. For example, distillation columns can be used in place of separators 210 and 211 where the incoming streams to the separator are cooled, expanded and introduced to the top of the column. Volatile impurities are flashed from the descending liquid and stripped by ascending vapor. Usually the incoming feed is cooled in a boiler/condenser against the liquid at the bottom of this column. Accordingly, distillation columns may be utilized in place of separators 210 and 211.

An embodiment which may be utilized to reduce the volatile contaminants in crude liquid nitrogen stream 20 from the high pressure column is to charge the liquid nitrogen stream from the high pressure column to the top of a third distillation column. Descending liquid then is stripped of volatile impurities by ascending vapor. A portion of the incoming feed air stream may be used to vaporize the nitrogen liquid in a boiler/condenser in the bottom of the column. The overhead from the fixed distillation column may be returned to an upper portion of high pressure column 202 and the liquid fraction would be transferred to separator 210.

If oxygen is not a desired product in the overall process, the flow scheme in FIG. 4 may be modified by associating boiler/condenser 208 with the high pressure column and adding an additional boiler/condenser and associating it with the bottom of the low pressure column.

FIG. 5 shows a volatile impurity rich purge stream 518 taken from the boiler/condenser 508. Alternatively, this purge may not be taken at all and the nitrogen rich stream 514 can be totally condensed in the boiler/condenser 508 located at the top of the high pressure column 508. In this option, the tray section between the top of the high pressure column and liquid nitrogen stream 530 withdrawl point will not be needed and liquid nitrogen stream 530 can be withdrawn as a portion of the condensed nitrogen stream 516 and fed to the low pressure column 504.

The following examples are provided to illustrate the embodiments of the invention and are not intended to restrict the scope thereof.

EXAMPLE 1

Ultra High Purity Liquid Nitrogen

An air separation process using the apparatus described in FIG. 1 was carried out. FIG. 1 shows a plant where primarily ultra high purity liquid nitrogen, liquid oxygen and liquid argon are produced. In this figure, feed air stream 12 containing light contaminants is fed at the bottom of the high pressure column. A gaseous nitrogen stream 26 is withdrawn a couple of trays below the top tray and is sent to nitrogen recycle liquefier 212 wherein the nitrogen is condensed. A liquid nitrogen stream 20 is also withdrawn from roughly the same location which eventually supplies the reflux to the low pressure column. No major product streams are withdrawn from the top of the high pressure column and the top 3–5 trays increase the concentration of the lights in the vapor phase. A non-condensible purge (stream 18) is taken from the boiler/condenser located at the bottom of the low pressure column. This purge contains a fairly high concentration of the lights and is responsible for removing the majority of the light contaminants from the system prior to introduction of any feed to the lower pressure column.

Feed streams to the nitrogen liquefier, particularly stream 26 from the high pressure column, have a significantly higher concentrations of light contaminants than other streams. Therefore, the returning liquid nitrogen stream 52 from the liquifier also has an undesirably high concentration of these components. This stream along with reflux stream 20 from the high pressure column is expanded and fed to separator 210. In this separator, about 2–15% of the total feed stream is flashed and comes out as vapor stream 54. The liquid nitrogen stream from the separator is fed as reflux to the top of the low pressure column. In some instances this liquid stream itself may meet product liquid nitrogen specifications. Generally a lower concentration is more desirable and it is favorable to feed this stream to the top of the low pressure column as reflux. The resulting descending liquid nitrogen stream at the top of the low pressure column is stripped further of the light components and a final liquid nitrogen product (stream 34) of high purity is withdrawn 1 to 5 trays below the top of the low pressure column. The vapor stream 54 from separator 210 is rich in light contaminants and is preferably discarded as a waste stream. In that way a gaseous nitrogen product is obtained from the low pressure column which is relatively pure.

Sample calculations for the flowsheet in FIG. 1 were done for a preselected process design. The concentration of hydrogen in the feed air was 6 ppm and the objective was to produce high purity liquid nitrogen. It is observed that the concentration of hydrogen in purge stream 18 is 0.8%. Its flow rate is fairly small at 0.06% of total flow rate of air stream 12 to the high pressure column and this stream is responsible for the removal of about 75% hydrogen contained in the feed air stream 12. The reflux liquid nitrogen stream 20 withdrawn from the high pressure column has 0.21 ppm hydrogen. When this stream, along with liquid nitrogen stream 52 from the liquifier, is flashed in separator 210, the concentration of hydrogen in liquid nitrogen from separator (stream 22) is reduced to 0.09 ppm. Even though this concentration is low, it may not meet the more stringent requirement of today's industry. If not, this resulting liquid from the separator may be fed to the top of the low pressure column and a liquid nitrogen product withdrawn from the low pressure column (stream 34) has about 0.2 ppb concentration of hydrogen.

One reason that the liquid nitrogen product in FIG. 1 is so pure is because the concentration of hydrogen in the vapor stream ascending in the low pressure column below the withdrawal point of liquid nitrogen product is fairly low. For example, this concentration is 0.06 ppm. This vapor, as it ascends the top few trays of the low pressure column, strips the descending liquid nitrogen of the light impurities and the liquid nitrogen product is purified. With the ascension of the vapor stream the concentration of lights in the vapor phase increases and the gaseous nitrogen leaving the top of the low pressure column will have about 0.19 ppm hydrogen.

The process of FIG. 1, as with others to be described, takes advantage of the fact that the equilibrium constant of the light contaminants is fairly high. For example, the equilibrium constant for hydrogen at the typical high pressure column pressures of 90–105 psia is 35–50. This implies that the concentration of hydrogen in the liquid phase in the high pressure column is about 1/35 to 1/50 of that in the vapor phase. Another fact which is exploited is that the value of this equilibrium constant increases rapidly as the pressure is decreased. Thus the value of the equilibrium constant for hydrogen at typical low pressure column pressures of 18–25 psia is in the neighborhood of 300. As a result, when a liquid from the high pressure column is let down in pressure, most of the light contaminants are contained in the flashed vapor and isolation of this flashed vapor leads to a gaseous nitrogen stream from the top of the low pressure column with much lower concentration of light contaminants.

EXAMPLE 2

Ultra High Purity Gaseous Nitrogen

The flowsheet described so far in FIG. 1 may have one major shortcoming. If a gaseous nitrogen product of high purity is required, the purest gaseous nitrogen stream available from this process is represented by stream 32 from the top of the low pressure column. The concentration of hydrogen in this stream may be about 0.021 ppm. In some applications it may be desirable to produce a gaseous nitrogen stream of even higher purity. FIG. 2 offers a variation for producing gaseous nitrogen of ultra high purity. The gaseous nitrogen product stream is withdrawn a couple of trays below the top tray in the low pressure column (stream 35). The concentration of the light contaminants in the vapor ascending the low pressure column from the bottom is extremely low, i.e., essentially the same as the concentration of stream 36. Therefore, the concentration of lights in the nitrogen vapor stream 35 is also extremely low. A small amount of vapor is allowed to travel upwards in the column and is collected as stream 32 from the top of the column. This vapor stream is required to strip the descending reflux liquid nitrogen stream 22 of the light contaminants. The flow of vapor stream 32 is such as to achieve the desired stripping in the top few trays of the low pressure column. Stream 32 can either be discarded as waste or it can be recycled to the nitrogen recycle liquefier. The main point is that the gaseous nitrogen product stream 35 should not be mixed with contaminated nitrogen stream 32. Thus, for the feed and product conditions of this flow sheet, it is possible to produce an additional gaseous nitrogen product stream with hydrogen concentrations of equal to or less than 2.5 ppb.

EXAMPLE 3

Ultra High Purity Gaseous Nitrogen

FIG. 4 illustrates other variations to the processes of FIGS. 1 and 2 and produces gaseous nitrogen at extremely high-purity. In this flowsheet, the pressure of the low pressure column is increased to a pressure which is higher than the conventional low pressure column pressure of 17–22 psia. Thus, the low pressure column is run such that pressure at the top of the low pressure column is higher than 22 psia. The liquid nitrogen stream 20 from the high pressure column is fed to a suitable location in the low pressure column which preferably is a couple of trays (1 to 5) below the top tray in the low pressure column. A liquid nitrogen stream 34 is withdrawn from a suitable location in the low pressure column. This suitable location is at least one tray below the feed point of liquid nitrogen reflux stream 20. A portion or all of this stream is then let down in pressure (stream 65) and vaporized in boiler/condenser 218 located at the top of the low pressure column. The vaporized stream 35 provides the desired high-purity gaseous nitrogen product. The top few trays in the low pressure column concentrate the lights in the vapor phase and when this stream is condensed in boiler/condenser 218, a stream 67 rich in light components is withdrawn as a purge stream. By associating a boiler/condenser with the low pressure column and by removing volatile impurities via line 67, it is possible to eliminate the taking of a purge via line 18 from the high pressure column. In that case, substantially all of the vapor removed via line 14 would be condensed and returned via line 16 to the high pressure column.

The advantage of the scheme in FIG. 4 is that the purity and recovery of the gaseous nitrogen product is high. This is because the flowrate of the purge stream 67 is much smaller than the purge streams from the top of the low pressure column and separator 210 as, for example, in FIG. 2.

What is claimed is:

1. In a process for the cryogenic separation of air which comprises nitrogen, oxygen and volatile impurities in an integrated multi-column distillation system, having a higher pressure column and a lower pressure column wherein the air stream is compressed, freed of condensible impurities, and cooled generating a feed for the integrated multi-column distillation system, the improvement for producing ultra high purity nitrogen at high nitrogen recovery which comprises:

a) generating a liquid nitrogen fraction and a nitrogen rich vapor fraction containing volatile impurities near the top of the higher pressure column;

b) removing a portion of the liquid nitrogen fraction from the higher pressure column;

c) expanding the liquid nitrogen fraction and introducing the expanded fraction to the top of the lower pressure column as feed;

d) generating a nitrogen rich vapor fraction containing residual volatile impurities at the top of the lower pressure column and removing that fraction as an overhead;

e) partially condensing at least one of said nitrogen rich vapor fractions generated in step (a) or (d) or both in a boiler/condenser;

f) removing at least a portion of at least one of the uncondensed nitrogen rich vapor fractions concentrated in volatile impurities from the boiler/condenser as a purge stream;

g) returning at least a portion of at least one of the condensed nitrogen rich vapor fractions to a column as reflux; and, h) generating and removing an ultra high purity nitrogen fraction as product from the lower pressure column at a point below the removal point for the nitrogen rich vapor containing volatile impurities and below the point of return of the liquid nitrogen fraction as reflux to the lower pressure column.

2. The process of claim 1 wherein the liquid nitrogen from the higher pressure column is expanded and the volatile impurities flashed therefrom in a separator.

3. The process of claim 2 wherein at least a portion of the nitrogen liquid obtained from the separator is returned to an upper portion of the lower pressure column as nitrogen reflux.

4. The process of claim 3 wherein a liquid nitrogen product is withdrawn from the lower pressure column at a point about 2–5 trays below the removal point for the nitrogen vapor containing residual volatile impurities.

5. The process of claim 3 wherein a nitrogen vapor product stream is withdrawn from an upper portion of the lower pressure column at a point below the removal point for nitrogen-rich vapor containing residual impurities.

6. The process of claim 2 wherein liquid nitrogen from the high pressure column is charged at the top of a distillation column and volatile components stripped therefrom with the resulting liquid fraction being charged to the separator used for introducing liquid nitrogen to the lower pressure column as reflux.

7. The process of claim 6 wherein the separator for returning liquid nitrogen to the lower pressure column is a distillation column.

8. The process of claim 7 wherein a nitrogen fraction rich in volatile impurities is generated in the lower pressure column and a portion of the nitrogen rich vapor fraction containing volatile impurities from the lower pressure column is charged to a separate boiler/condenser and condensed with the condensed fraction returned as reflux to the lower pressure column and the uncondensed fraction removed as a purge.

9. In a process for the cryogenic separation of an air stream in an integrated multi-column distillation system having a higher pressure column, a lower pressure column, and a side arm column for separation of argon, the improvement for producing ultra high purity nitrogen product, while enhancing nitrogen recovery which comprises:

a) feeding substantially all of said cooled air stream to the higher pressure column;

b) generating a liquid nitrogen fraction and a nitrogen rich vapor fraction containing volatile impurities near the top of the higher pressure column;

c) removing a portion of the liquid nitrogen fraction from the higher pressure column at a point below a removal point designated for the removal of a nitrogen rich vapor fraction containing volatile impurities;

d) expanding the liquid nitrogen fraction and introducing the expanded fraction to the top of the lower pressure column as feed;

e) generating a nitrogen rich vapor fraction containing residual volatile impurities fraction at the top of the lower pressure column and removing that fraction as an overhead; and, f) partially condensing at least one of said nitrogen rich vapor fractions generated in step (b) or step (e) in a boiler/condenser and returning at least a portion of at least one the condensed nitrogen rich vapor fractions to a column as reflux;

g) removing at least a portion of at least one of the uncondensed nitrogen rich vapor fractions concentrated in volatile impurities generated in step (f) from the boiler/condenser as a purge stream;

h) removing an argon stream from the low pressure column and fractionating that argon stream in said side arm column and recovering an argon rich product as overhead; and, j) generating and removing an ultra high purity nitrogen fraction as product from the lower pressure column at a point below the removal point for the nitrogen rich vapor containing residual volatile impurities and below the point of return of the liquid nitrogen fraction as reflux to the lower pressure column.

10. The process of claim 9 wherein a nitrogen fraction rich in volatile impurities is generated in the high pressure column and a portion of the nitrogen rich vapor fraction containing volatile impurities from the high pressure column is charged to a separate boiler/condenser and condensed with the condensed fraction returned as reflux to the high pressure column and the uncondensed fraction removed as a purge.

11. The process of claim 10 wherein the liquid nitrogen from the higher pressure column is expanded and the volatile impurities flashed therefrom in a separator.

12. The process of claim 11 wherein at least a portion of the nitrogen liquid obtained from the separator is returned to an upper portion of the lower pressure column as nitrogen reflux.

13. The process of claim 12 wherein liquid nitrogen product is withdrawn from the lower pressure column at a point about 2–5 trays below the removal point for the nitrogen vapor containing residual volatile impurities.

14. The process of claim 13 wherein a nitrogen vapor product stream is withdrawn from an upper portion of the lower pressure column as a point below the removal point for nitrogen-rich vapor containing residual impurities.

15. The process of claim 14 wherein liquid nitrogen from the high pressure column is charged at the top of a distillation column and volatile components stripped therefrom with the resulting liquid fraction being charged to the separator used for introducing liquid nitrogen to the lower pressure column as reflux.

16. The process of claim 14 wherein the separator for returning liquid nitrogen to the lower pressure column is a distillation column.

17. The process of claim 16 wherein liquid oxygen is withdrawn from the bottom of the lower pressure column, expanded, separated into liquid and vapor components in a separator and the liquid component vaporized in a boiler/condenser in the argon column.

18. The process of claim 17 wherein the separator for separating the expanded liquid oxygen is a distillation column and the liquid oxygen is cooled in a boiler/condenser with said distillation prior to expansion and the resulting expanded oxygen charged to the top of said distillation column.

* * * * *